US012343608B2

(12) United States Patent
Flooks et al.

(10) Patent No.: US 12,343,608 B2
(45) Date of Patent: Jul. 1, 2025

(54) BICYCLE TRAINER

(71) Applicant: Wahoo Fitness L.L.C., Atlanta, GA (US)

(72) Inventors: Ana Flooks, San Francisco, CA (US); Russell Mead, Chapel Hill, NC (US); Austin Smith Igleheart, IV, Atlanta, GA (US); Adnan Abbas, Roswell, GA (US); Shane Adam Byler, Mableton, GA (US)

(73) Assignee: Wahoo Fitness L.L.C., Atlanta, GA (US)

( * ) Notice: Subject to any disclaimer, the term of this patent is extended or adjusted under 35 U.S.C. 154(b) by 237 days.

(21) Appl. No.: 18/314,455

(22) Filed: May 9, 2023

(65) Prior Publication Data

US 2024/0374979 A1 Nov. 14, 2024

(51) Int. Cl.
*A63B 69/16* (2006.01)

(52) U.S. Cl.
CPC ..... *A63B 69/16* (2013.01); *A63B 2069/165* (2013.01); *A63B 2225/093* (2013.01)

(58) Field of Classification Search
CPC ..... A63B 69/16; A63B 2069/165; A63B 2225/093; A63B 21/00069; A63B 21/0051; A63B 21/225; A63B 2069/164; A63B 2069/163; A63B 2069/161; A63B 2069/162; A63B 21/22; A63B 22/16;
(Continued)

(56) References Cited

U.S. PATENT DOCUMENTS 9,999,818 B2 6/2018 Hawkins, III et al.
10,974,118 B2 4/2021 Bass et al.
(Continued)

FOREIGN PATENT DOCUMENTS

ES 2711417 T3 * 5/2019 ..... A63B 21/0053
TW M593633 U 4/2020
TW M624736 U 3/2022

OTHER PUBLICATIONS

Wahoo KickrMove Smart Trainer* (Atkinson), Dec. 9, 2023 (Dec. 9, 2023), [online], retrieved from <URL:https://road.cc/content/review/wahoo-kickr-move-smart-trainer-305527>, entire document.

(Continued)

*Primary Examiner* — Megan Anderson
*Assistant Examiner* — Juan Carlos De Leon Diaz
(74) *Attorney, Agent, or Firm* — Harness, Dickey & Pierce, P.L.C.

(57) ABSTRACT

A bicycle trainer includes a frame assembly including a pair of support legs connected to a center structure. The center structure includes a first curved track and a second curved track longitudinally spaced along the center structure from the first curved track. The frame assembly includes a glide base having a first guide roller engaged with the first curved track and a second guide roller engaged with the second curved track. The frame assembly including a main frame member coupled to the glide base. A first axle is supported by the main frame member, the first axle adapted to be connected to a pair of drop-outs from a bicycle with a rear wheel removed from the pair of drop-outs to operably connect the bicycle to the bicycle trainer. A resistance unit is drivingly coupled to the first axle.

22 Claims, 11 Drawing Sheets

(58) Field of Classification Search
CPC . A63B 22/0023; A63B 22/0015; A63B 22/06; A63B 22/0605; A63B 26/003
See application file for complete search history.

(56) References Cited

U.S. PATENT DOCUMENTS

| | | | | |
|---|---|---|---|---|
| 11,534,656 | B2 | 12/2022 | Smits | |
| 2011/0136630 | A1 | 6/2011 | Zwinkels | |
| 2019/0070476 | A1* | 3/2019 | Bass | A63B 21/005 |
| 2020/0122011 | A1* | 4/2020 | Papadopoulos | A63B 69/16 |
| 2021/0052937 | A1* | 2/2021 | Chen | A63B 21/0428 |
| 2022/0023712 | A1* | 1/2022 | Chen | A63B 21/15 |
| 2022/0203196 | A1* | 6/2022 | Hawkins, III | A63B 21/0052 |
| 2022/0387870 | A1 | 12/2022 | Yu et al. | |

OTHER PUBLICATIONS

Office Action from related application TW113117081, dated Jan. 21, 2025.

* cited by examiner

BICYCLE TRAINER

FIELD

The present disclosure relates to a bicycle trainer and more particularly to a bicycle trainer having improved acceleration feel.

BACKGROUND

This section provides background information related to the present disclosure which is not necessarily prior art.

Busy schedules, bad weather, focused training, and other factors cause bicycle riders ranging from the novice to the professional to train indoors. Numerous indoor training options exist including exercise bicycles and trainers. An exercise bicycle looks similar to a bicycle but without wheels, and includes a seat, handlebars, pedals, crank arms, a drive sprocket and chain. An indoor trainer, in contrast, is a mechanism that allows the rider to mount her actual bicycle to the trainer, with or without the rear wheel, and then ride the bike indoors. The trainer provides the resistance and supports the bike but otherwise is a simpler mechanism than a complete exercise bicycle. Such trainers allow a user to train using her own bicycle, and are much smaller than full exercise bicycles, and often are less expensive than full exercise bicycles.

While very useful, conventional trainers nonetheless suffer from many drawbacks. For example, it is often difficult to level conventional trainers from side to side. Moreover, riding a slightly tilted bicycle is uncomfortable and can cause unintended damage to the bicycle. In another example, many riders prefer that their bicycle be level fore and aft so that it feels like the rider is training on a flat surface as opposed to an incline or decline. Most conventional trainers, however, cannot be vertically adjusted so the rider places boards, books, or the like under the trainer to elevate the entire trainer, or under the front wheels to elevate the front of the bicycle.

While many trainers are portable based on the simple fact that they are relatively small. Such trainers are nonetheless heavy, can be awkward to load into car trunks, and can still occupy substantial space when not in use. Portability, however, is important as some folks may want to store their trainer when not in use and some folks may take their trainer to races and the like in order to warm-up before a race and cool-down afterward. Finally, providing an improved and more realistic rider feel on the trainer is also important.

With these thoughts in mind among others, aspects of the trainer disclosed herein were conceived.

SUMMARY

This section provides a general summary of the disclosure, and is not a comprehensive disclosure of its full scope or all of its features.

Aspects of the present disclosure involve a bicycle trainer that provides several advantages over conventional designs. The trainer includes a vertically adjustable rear axle and cassette (rear bicycle gears) where the user mounts her bicycle to the trainer. Generally speaking, the user removes her rear wheel from the drop outs at the rear of the bicycle (not shown) and then connects the rear axle and cassette of the trainer to the drop outs in the same manner that the rear wheel would be coupled to the bicycle.

The cassette is coupled to a pulley that drives a belt connected to a flywheel or other resistance mechanism such that when the user is exercising, her pedaling motion drives the flywheel. The flywheel includes an electromagnetic brake that is controllable. Further, torque imparted on the flywheel by a rider pedaling a bicycle mounted on the trainer, is measured at a bracket interconnecting a portion of the flywheel with a stationary portion of the frame. Based on power measurements, RPM, heart rate and other factors, the magnetic brake may be controlled. Control of the trainer, and display of numerous possible features (power, RPM, terrain, video, user profile, heart rate, etc.) may be provided through a dedicated device or through a smart phone, tablet or the like, running an app configured to communicate with the trainer.

In one embodiment of the bicycle trainer, the trainer includes a frame assembly that supports an axle to which a rear wheel of a bicycle may be connected. According to an aspect of the present disclosure, the frame assembly includes a pair of support legs connected to a center structure. The center structure includes a first curved track and a second curved track longitudinally spaced along the center structure from the first curved track. The frame assembly includes a glide base having a first guide roller engaged with the first curved track and a second guide roller engaged with the second curved track. The frame assembly includes a main frame member coupled to the glide base. A first axle is supported by the main frame member, the first axle adapted to be connected to a pair of drop-outs from a bicycle with a rear wheel removed from the pair of drop-outs to operably connect the bicycle to the bicycle trainer. A resistance unit is drivingly coupled to the first axle.

According to a further aspect, the first curved track includes a pair of first curved track members on opposite sides of the glide base and the first guide roller includes a pair of first guide rollers on opposite sides of the glide base and each engaged with a respective one of the pair of first curved track members.

According to a further aspect, the center structure includes an elongated leg and the pair of first curved track members are disposed on opposite sides of the elongated leg.

According to a further aspect, the glide base includes a rear bracket that supports the first support guide roller and an elongated rail that is connected to the rear bracket and supports the second support guide roller.

According to a further aspect, the first support guide roller includes a pair of first support guide rollers and the rear bracket is U-shaped with one of each of the pair of first support guide rollers being supported to a respective leg of the U-shaped rear bracket and the main frame member is pivotally coupled between the legs of the U-shaped rear bracket.

According to a further aspect, the frame assembly is vertically adjustable.

According to a further aspect, the frame assembly includes an adjustment bracket pivotally connected with the main frame member and adjustably connected to the glide base.

According to a further aspect, the pair of support legs are each pivotally mounted to the center bracket.

According to a further aspect, a lockout mechanism is selectively engageable to prevent movement between the glide base and the center structure.

According to another aspect of the present disclosure, a bicycle trainer includes a frame assembly including a mounting bracket with a pair of support legs mounted to the mounting bracket. A center structure is mounted to the mounting bracket between the pair of support legs. The center structure includes a first curved track and a second curved track longitudinally spaced along the center structure from the first curved track. The frame assembly includes a glide base having a first guide roller engaged with the first curved track and a second guide roller engaged with the second curved track. The frame assembly includes a main frame member pivotally coupled to the glide base. A first axle is supported by the main frame member. The first axle is adapted to be connected to a pair of drop-outs from a bicycle with a rear wheel removed from the pair of drop-outs to operably connect the bicycle to the bicycle trainer. A resistance unit is drivingly coupled to the first axle.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modification in various aspects, all without departing from the spirit and scope of the presently disclosed technology. Accordingly, the drawings and detailed description are to be regarded as illustrative in nature and not limiting.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Aspects of the present disclosure involve a bicycle trainer that provides several advantages over conventional designs. The trainer includes a vertically adjustable rear axle and cassette (rear bicycle gears) where the user mounts her bicycle to the trainer. Generally speaking, the user removes her rear wheel from the drop outs at the rear of the bicycle and then connects the rear axle and cassette of the trainer to the drop outs in the same manner that the rear wheel would be coupled to the bicycle.

The cassette is coupled to a pulley that drives a belt connected to a flywheel or other resistance mechanism such that when the user is exercising, her pedaling motion drives the flywheel. The flywheel includes an electromagnetic brake that is controllable. Further, torque imparted on the flywheel by a rider pedaling a bicycle mounted on the trainer, is measured at a bracket interconnecting a portion of the flywheel with a stationary portion of the frame. Based on power measurements, RPM, heart rate and other factors, the magnetic brake may be controlled. Control of the trainer, and display of numerous possible features (power, RPM, terrain, video, user profile, heart rate, etc.) may be provided through a dedicated device or through a smart phone, tablet or the like, running an app configured to communicate with the trainer.

Figure 1:
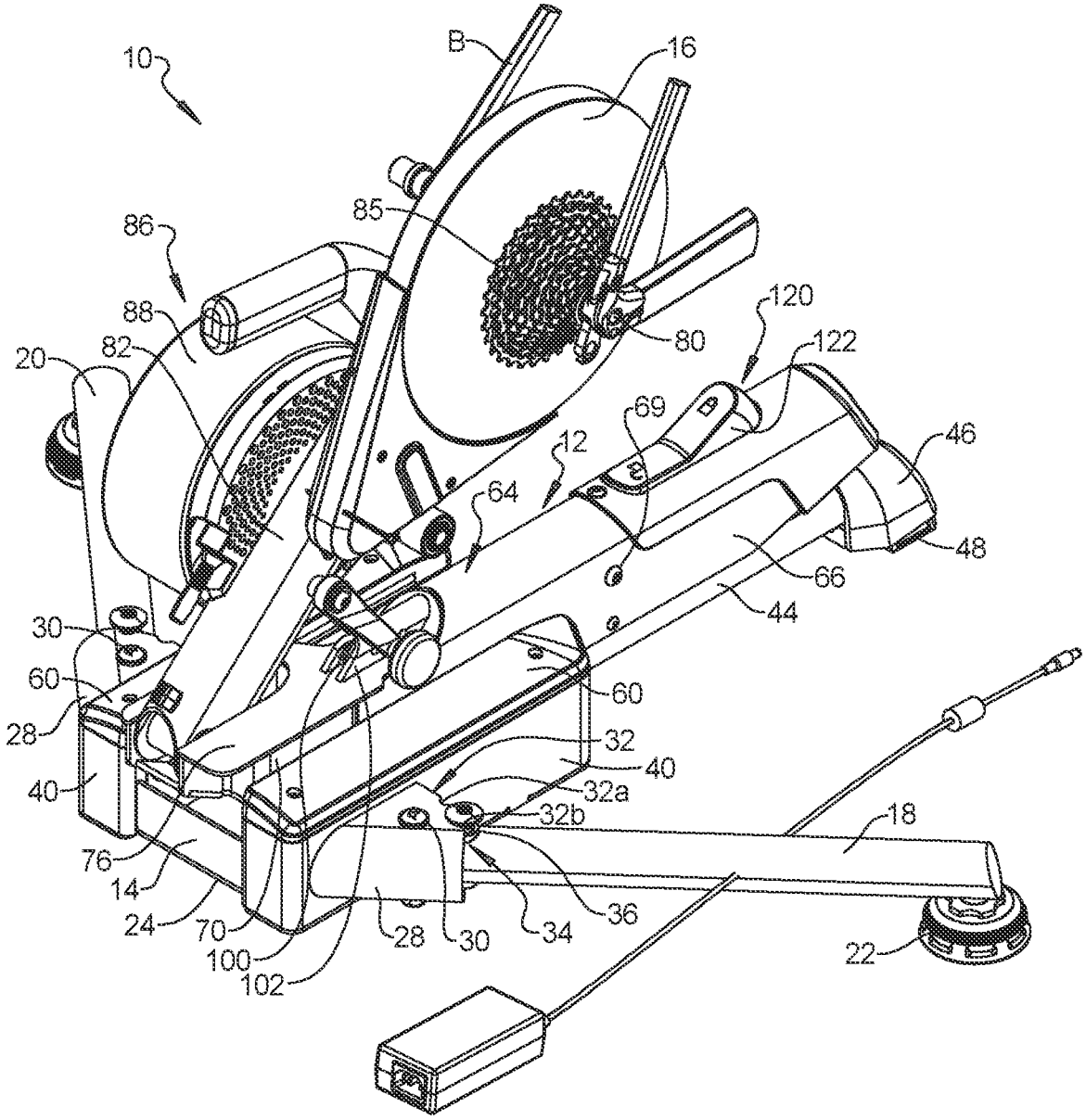
FIG. 1 is a right rear isometric view of a trainer according to the principles of the present disclosure.

More particularly, with reference to FIG. 1, a bicycle trainer 10 includes a center structure 12 coupled to and extending forwardly from a rear mounting bracket 14. The center structure 12 is arranged below a pulley 16 and offset slightly from a longitudinal centerline of the trainer 10. A pair of support legs 18, 20 are pivotally coupled to and at opposing sides of the rear mounting bracket 14. The first and second support legs 18, 20 are configured to pivot inward toward the center structure 12 for storage and movement of the trainer 10, and the first and second support legs 18, 20 are capable of pivoting outward and away from the center structure 12 to laterally support the trainer 10 when the trainer 10 is in use.

Figure 10:
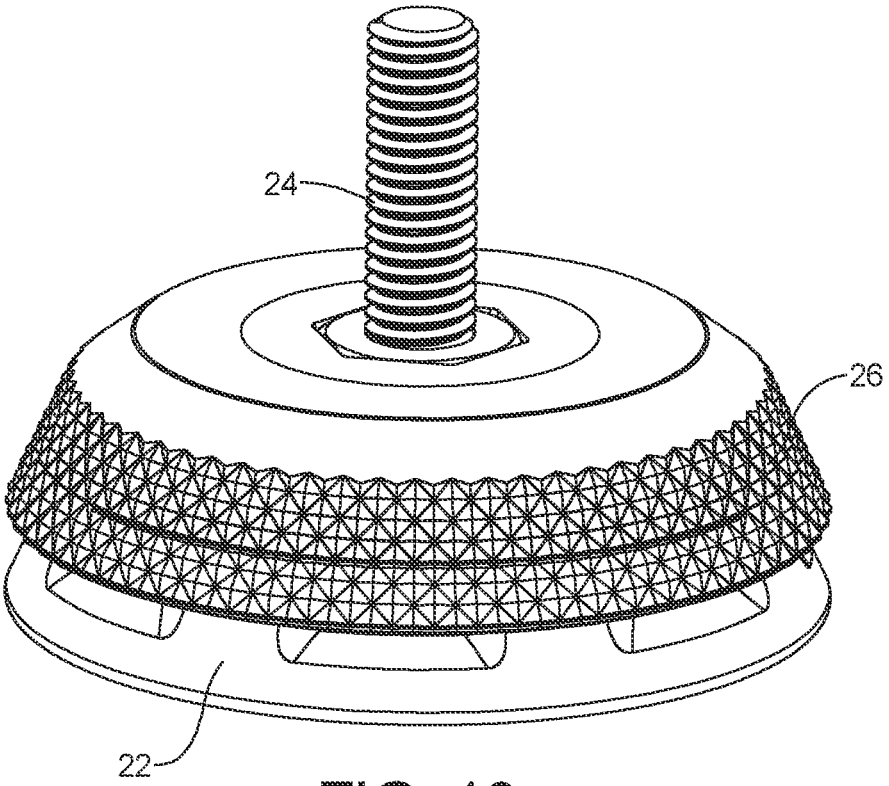
FIG. 10 is a side plan view of a flexible adjustable leveling support pad.

A distal end of the first and second support legs 18, 20 are provided with flexible and adjustable leveling support pads 22. Additionally, an elongate pad 24 is coupled to a bottom side of the rear mounting bracket 14. Each pad 22 and leg 18, 20 functions in the same manner so the first pad 22 at the outer end of the first leg 18 is discussed in detail. Referring to FIG. 10, the pad 22 is adjustably mounted to the leg 18 to allow the trainer 10 to be leveled, transverse the longitudinal centerline, and thereby maintain the mounted bicycle in a side-to-side level orientation. While other alternatives are possible, in the example illustrated in the figures, the leg 18 defines a threaded aperture and the pad 22 is coupled with a threaded member 24 that engages the aperture. An adjustment collar 26 is coupled with the threaded member such that rotation of the collar 26 causes the pad 22 to move vertically relative to the leg 18. The pad 22 is made from rubber or another elastomeric material so that the pad is capable of flexing when the rider exerts forces in a side ward manner. Accordingly, the flexible pads 22 provide the user with a side-to-side sway that more closely simulates the ride of a road bicycle. In addition, a user can quickly and easily adjust the pads 22 on one or both of the first and second support legs 18, 20 and thereby level the trainer 10, even on an uneven or slanted surface.

Each of the first and second support legs 18, 20 are pivotally supported to a respective one of a pair of side pivot brackets 28 by a pivot pin 30. The pair of side pivot brackets 28 each include an upper arcuate surface 32 having a pair of notches 32*a*, 32*b*, one of which 32*a* corresponding to an inwardly pivoted configuration of the first and second support legs 18, 20, and the second notch 32*b* corresponding with an outwardly pivotal (as shown) configuration of the first and second support legs 18, 20. A retention assembly 34 is coupled with the leg adjacent the upper arcuate surface and notches 32*a*, 32*b*. The retention assembly 34 includes a spring loaded pin 36 with a user engageable head 38. The pin 36 supports a collar that selectively fits within the notches 32*a* and 32*b*. By depressing the pin 36 against the spring, the collar moves downwardly into a recess defined in the leg 18, 20 and disengages the respective notch 32*a*, 32*b*. The leg may then be pivoted inwardly or outwardly, and when the user releases the pin 36, the spring nudges the pin 36 upward causing the collar to engage one of the respective notches 32*a*, 32*b* securing the leg 18, 20 in the desired position.

Figure 11:
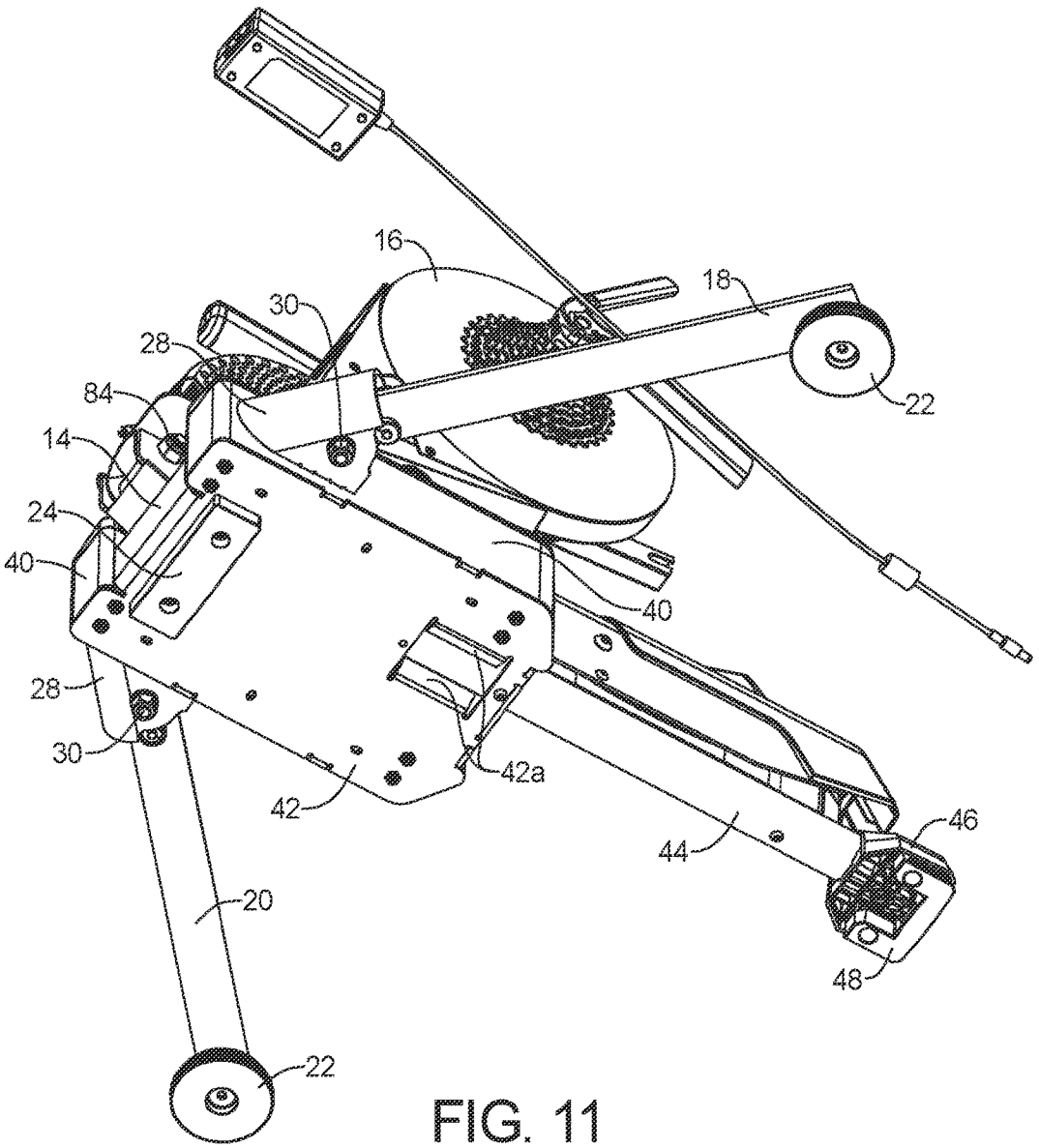
FIG. 11 is a bottom perspective view of the trainer shown in FIG. 1.

The pair of side pivot brackets 28 are each connected to a respective one of a pair of side housings 40 that are each connected to opposite sides of the rear mounting bracket 14. As shown in FIG. 10, a bottom plate 42 is connected to a bottom of the rear mounting bracket 14 and to the pair of side housings 40. A center base structure 44 that can be in a form of a tube is attached to the bottom plate 42 by fasteners. With reference to FIG. 11, the bottom plate 42 can further include bent flanges 42*a* that reinforce the center base structure 44. A cap 46 can be provided on a distal end of the center base structure 44. The cap 46 can include a rubber pad 48 for engaging the floor.

Figure 5:
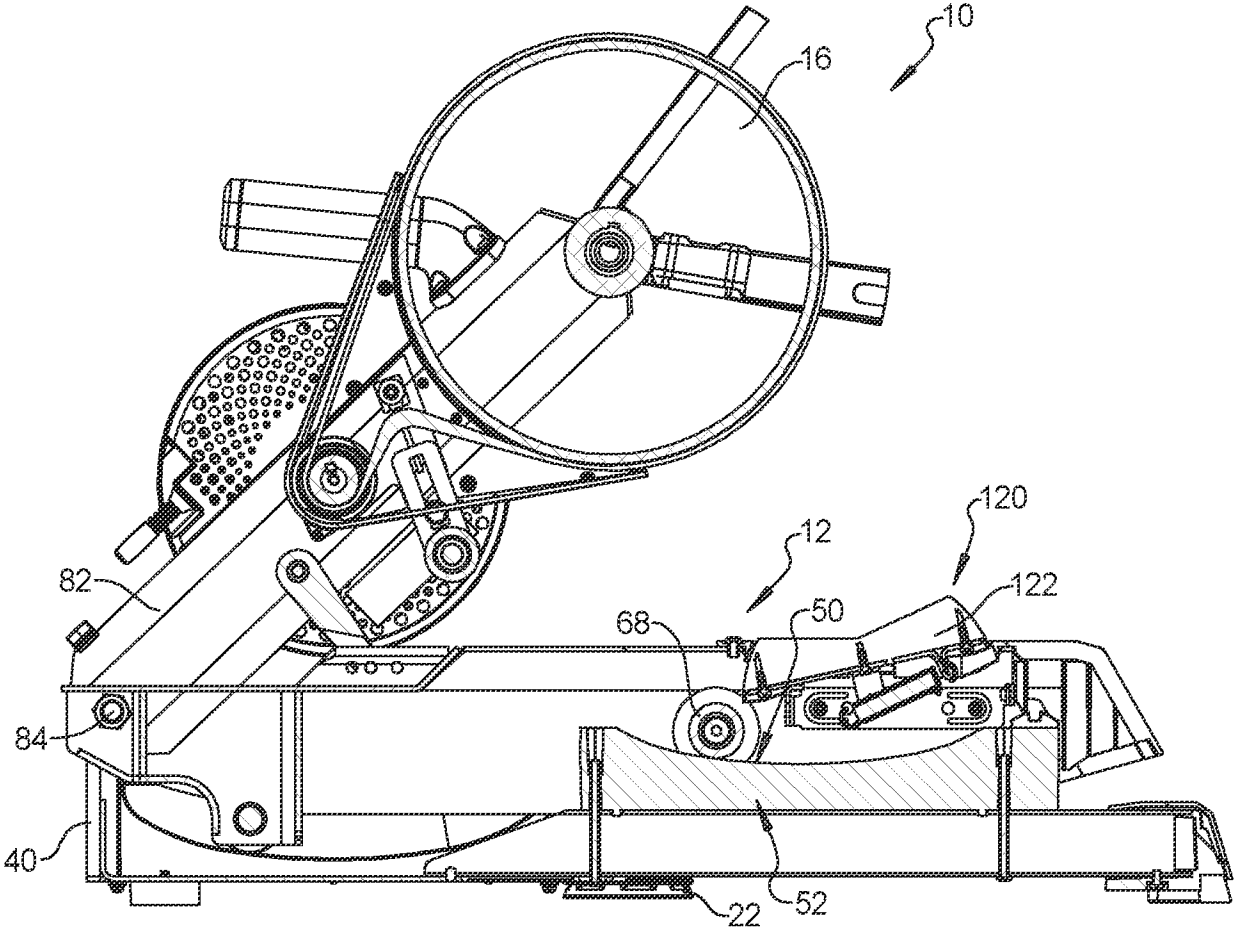
FIG. 5 is a cross-sectional view taken along a forward center curved track according to the principles of the present disclosure.
Figure 7:
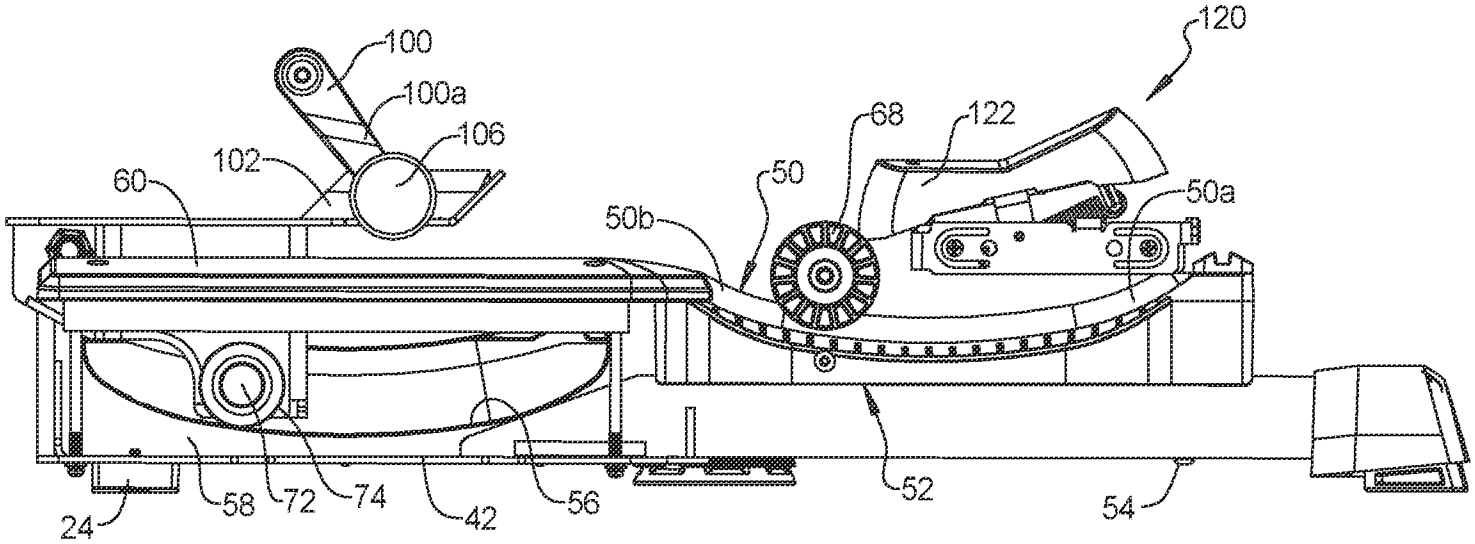
FIG. 7 is a side plan view of a base portion of the trainer according to the principles of the present disclosure.

With reference to the cross-sectional view of FIG. 5 and the plan view of FIG. 7, a front curved track 50 is mounted to an upper surface of the center base structure 44. The front curved track 50 can be formed from a plastic molding 52 having reinforcing ribs and that is mounted to the center base structure by fasteners 54. The plastic molding 52 can have a partial cylindrical recess for receiving the center base structure 44 in the form of a tube. The front curved track 50 is elongated along the center base structure 44 with forward and rearward ends 50*a*, 50*b* of the front curved track 50 curving upward.

Figure 4:
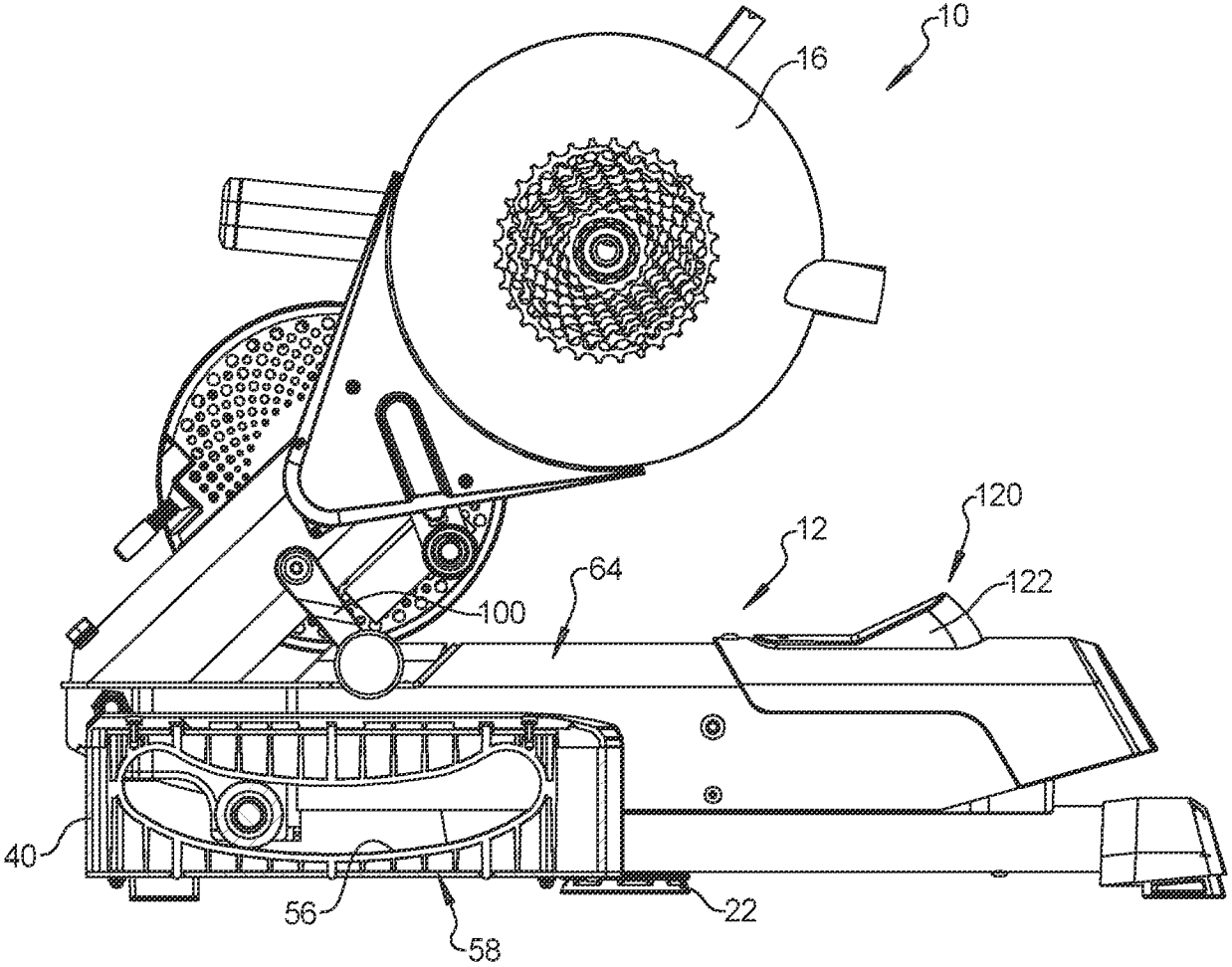
FIG. 4 is cross-sectional view taken along a right rear curved track according to the principles of the present disclosure.
Figure 6:
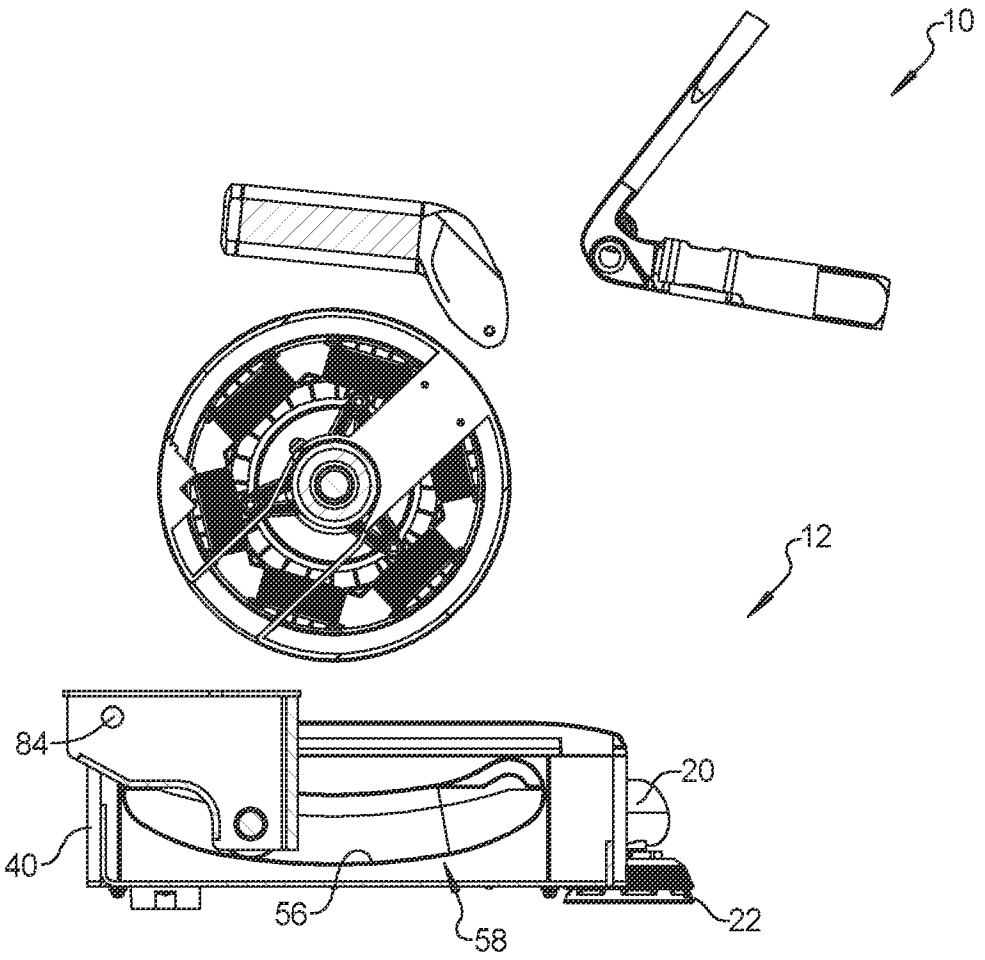
FIG. 6 is cross-sectional view taken along a left rear curved track according to the principles of the present disclosure.

With reference to FIGS. 4 and 6, each of the pair of side housings 40 include a rear curved track 56 that can be formed as a curved slot in a side face of a plastic molding 58. The pair of side housings 40 are each open toward the center base structure 44. As shown in FIG. 1, a cover 60 is provided on top of each of the pair of side housings 40 while the bottom plate 42 encloses a bottom of each of the pair of side housings 40.

Figure 8:
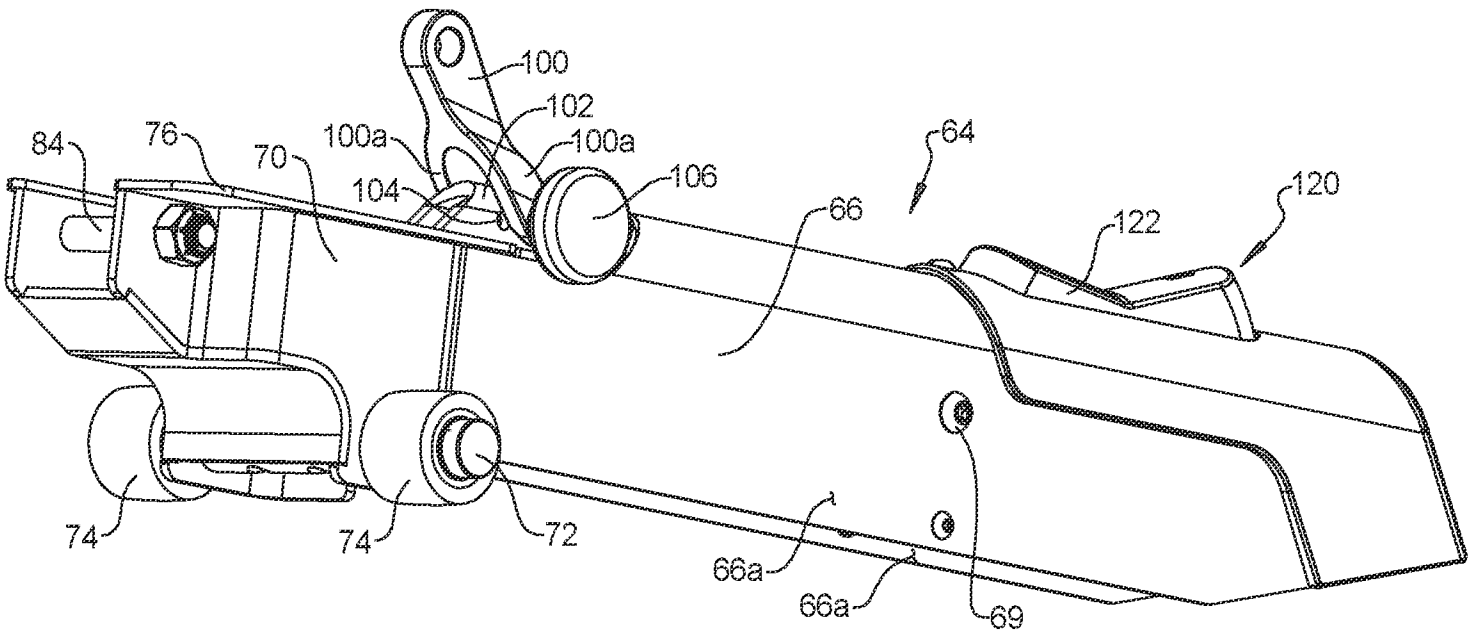
FIG. 8 is a perspective view of a glide portion of the trainer according to the principles of the present disclosure.

With reference to FIGS. 1 and 8, a glide assembly 64 is shown that is disposed between the pair of side housings 40 and includes a slider center channel 66 that has a pair of sidewalls 66*a* that support a front roller 68 (See FIGS. 5, 7, and 9) in rolling engagement with the front curved track 50. The front roller 68 is supported by a shaft 69 (See FIG. 8) extending through the sidewalls 66*a*. A slider rear channel 70 is connected to the slider center channel 66 and the slider rear channel 70 supports a shaft 72 that rotatably supports a pair of rear rollers 74. Each of the pair of rear rollers 74 are supported in rolling engagement with the pair of rear curved tracks 56 within the pair of side housings 40, as shown in FIGS. 4 and 6, respectively. The pair of rear rollers 74 provide lateral support for the bicycle B. As shown in FIGS. 1 and 8, a rear channel cover 76 is mounted to a top of the slider rear channel 70.

With reference to FIG. 1, the pulley 16 is mounted to an axle 80 that is supported by a main frame member 82 that is pivotally connected to the slider rear channel 70 by a pivot pin 84 (best shown in FIGS. 5 and 8) to adjust a height at which a bicycle B is supported. Thus, the main frame member 82 may be pivoted upwardly or downwardly relative to the orientation illustrated in the drawings to vertically adjust the height of the bicycle B. The main frame member 82 extends forwardly and upwardly from the slider rear channel 70. A cassette 85 (rear bicycle gears) are mounted on the axle 80 adjacent to the pulley 16.

Figure 2:
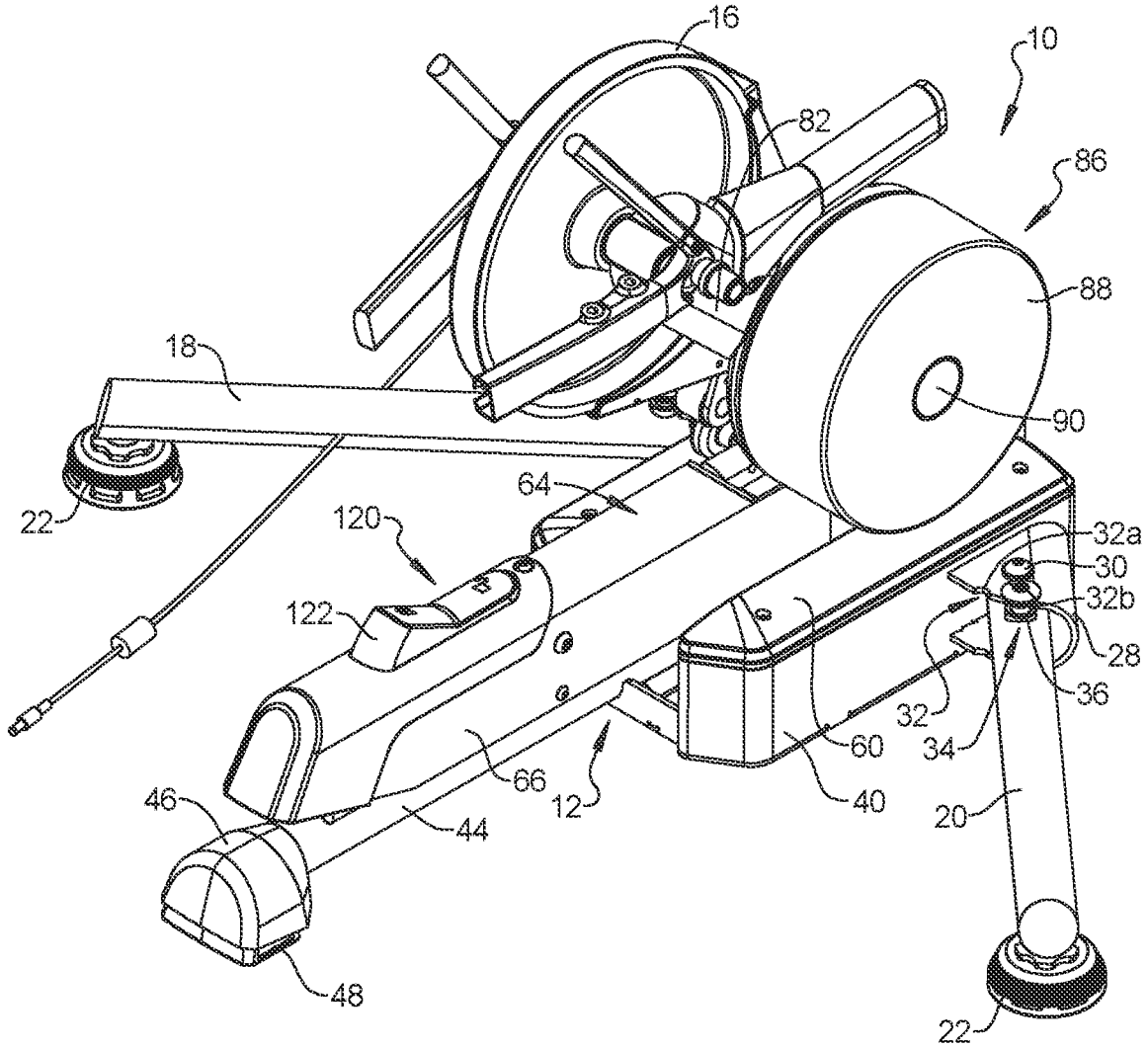
FIG. 2 is a left front isometric view of the trainer of FIG. 1.
Figure 3:
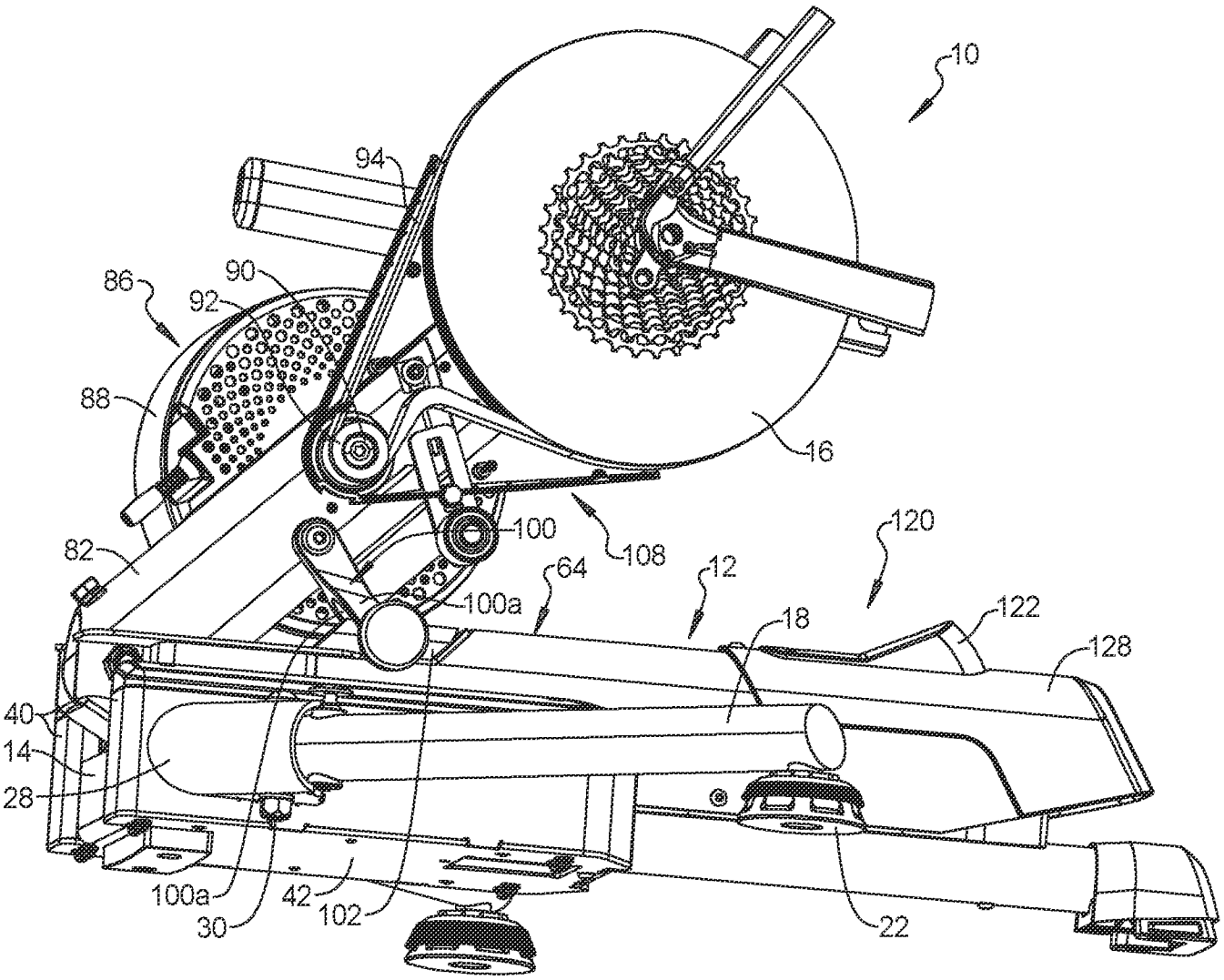
FIG. 3 is a right side view of a portion of the trainer in FIG. 1 with a portion of the housing removed for exposing the flywheel belt drive system.

With reference to FIGS. 1-3, a flywheel 86 is supported by the main frame member 82. The flywheel assembly 86 includes an outer relatively heavy flywheel member 88 that is configured to rotate relative to a plurality of internal components that are substantially fixed relative to the outer rotatably flywheel member 88. The flywheel member 88 is coupled with a flywheel axle 90 that communicates through and is rotatably supported by the main frame member 82. The flywheel axle 90 also includes a second flywheel pulley 92 that rotates in conjunction with the first flywheel pulley 16 through a belt 94. The belt 94 interconnects the pulleys 16, 92 and may include teeth that correspond to teeth on the first and second pulleys 16, 92. In the depicted arrangement, a user's pedaling force is translated through the belt 94 from the first larger pulley 16 to the second pulley 92 supported on the flywheel axle 90, which in turn causes the flywheel member 88 to rotate. The flywheel assembly 86 provides a resistance unit that can alternatively or additionally include a braking mechanism or other mechanism to provide resistance to the rider.

As seen in FIGS. 1, 3, 7 and 8, a height adjustment bracket 100 is coupled between the main frame member 82 and the rear channel cover 76 of the center structure to maintain the main member 82 in a desired height. More specifically, at a forward end, the adjustment bracket 100 includes a u-shaped portion defining opposing members 100*a* that are arranged on either side of a center adjustment rail 102 on the center structure. Each member 100*a* defines an aperture. The center adjustment rail 102 defines a plurality of apertures 104 along its length that are configured to receive a pin 106 that extends through the opposing member 100*a* apertures 100*b* and one of the pluralities of apertures 104 in the center adjustment rail 102. In the illustrated example, the aperture opposite the portion of the pin that includes a handle portion is threaded. Similarly, the end of the pin, opposite the handle, is also threaded. By fixing the bracket 100 with one of the plurality of apertures 104 along the center adjustment rail 102, a user can raise or lower the main member 82 thereby raising or lowering the axle 80 to which the bicycle B is mounted.

As shown in FIG. 3, a belt tensioner assembly 108 is mounted on the main frame member 82 and is used to mount and remove the belt 94 to and from the pulleys 16, 92, and also to adjust the tension of the belt 94 for proper function. The belt 94 is positioned around the tensioner assembly 108, and by adjusting the tensioner assembly 108 fore and aft, the tension on the belt 94 can be increased or decreased.

Figure 9:
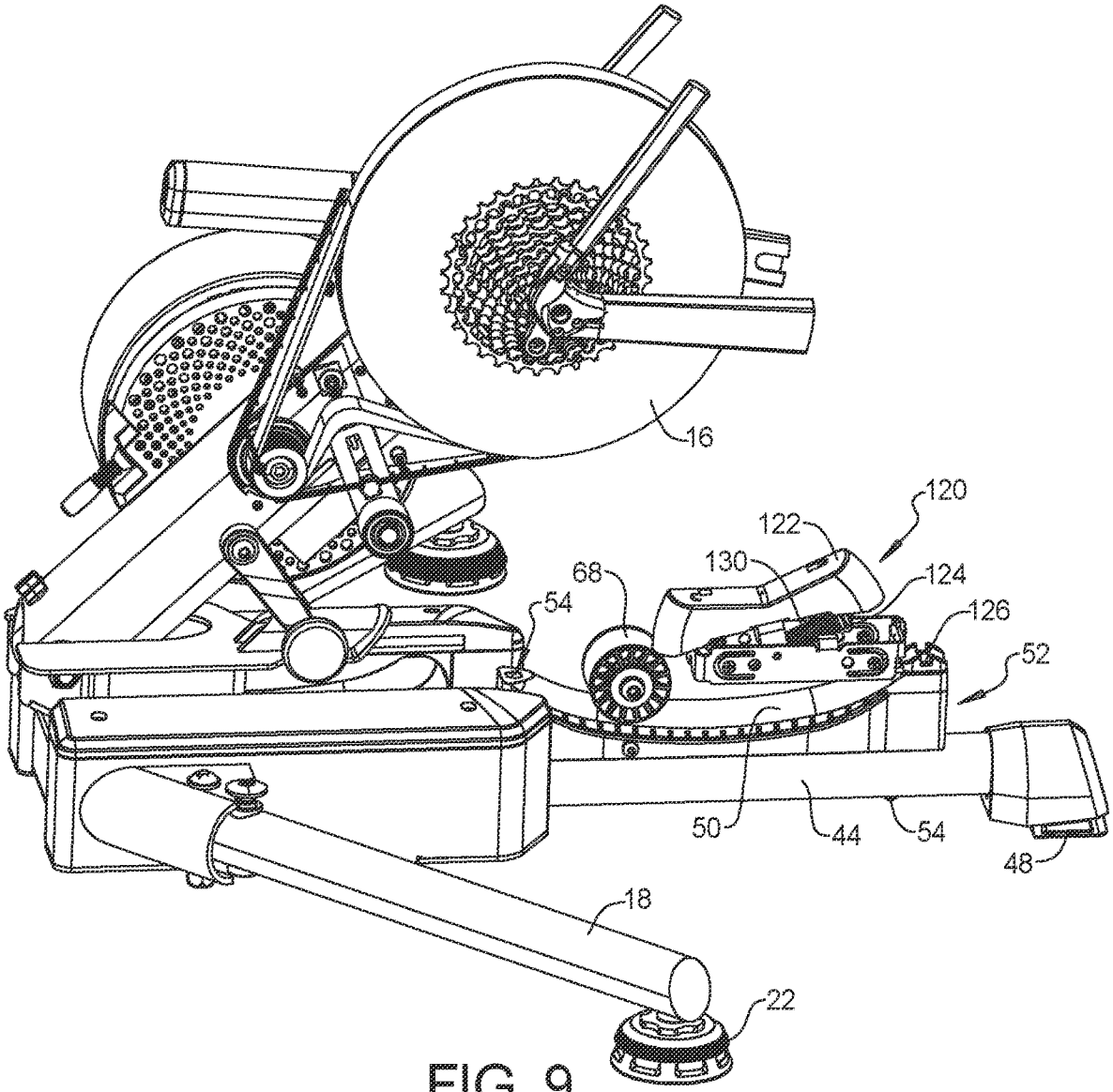
FIG. 9 is a detailed perspective view of a lockout mechanism of the trainer according to the principles of the present disclosure.

With reference to FIG. 9, a lockout mechanism 120 is shown including a lockout button 122 that can be toggled between an un-locked position (FIGS. 1 and 9) and a lockout position (FIGS. 7 and 8). The lockout mechanism 120 includes a tooth 124 movable with the lockout button 122 into and out of engagement with a recess 126 on a forward end of the plastic molding 52 of the front curved track 50. The engagement of the tooth 124, which is mounted to the glide assembly 64, with the recess 126, which is mounted to the center base structure 44, prevents the glide feature from operating. The lockout mechanism is supported within a nose cover 128 (removed for illustration purposes in FIG. 9) mounted to a forward end of the slider center channel 66 of the slider assembly 64. The lockout button 122 is engaged by a toggle spring 130 that biases the lockout button 122 to the un-locked position (FIG. 1) and the lockout position (FIGS. 7 and 8) when the lockout button 122 passes over a center toggle position.

In operation, the slider assembly 64 is able to move forward and rearward along the front curved track 50 and the pair of rear curved tracks 56 in response to rider accelerations and provide an improved rider experience. The lockout mechanism 120 can be engaged to prevent the slider assembly 64 from moving relative to the front curved track 50 and rear curved tracks 56, as discussed above.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member, the first axle adapted to be connected to a pair of drop-outs from a bicycle with a rear wheel removed from the pair of drop-outs to operably connect the bicycle to the bicycle trainer; and a resistance unit drivingly coupled to the first axle, wherein the first curved track includes a pair of first curved track members on opposite sides of the glide base and the first guide roller includes a pair of first guide rollers on opposite sides of the glide base and each engaged with a respective one of the pair of first curved track members.

2. The bicycle trainer of claim 1, wherein the glide base includes a rear bracket that supports the first support guide roller and an elongated rail that is connected to the rear bracket and supports the second support guide roller.

3. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member, the first axle adapted to be connected to a pair of drop-outs from a bicycle with a rear wheel removed from the pair of drop-outs to operably connect the bicycle to the bicycle trainer; and a resistance unit drivingly coupled to the first axle;

wherein the first support guide roller includes a pair of first support guide rollers and the rear bracket is U-shaped with one of each of the pair of first support guide rollers being supported to a respective leg of the U-shaped rear bracket and the main frame member is pivotally coupled between the legs of the U-shaped rear bracket.

4. The bicycle trainer of claim 1, wherein the center structure includes an elongated leg and the pair of first curved track members are disposed on opposite sides of the elongated leg.

5. The bicycle trainer of claim 1, wherein the frame assembly is vertically adjustable.

6. The bicycle trainer of claim 1, wherein the frame assembly includes an adjustment bracket pivotally connected with the main frame member and adjustably connected to the glide base.

7. The bicycle trainer of claim 1, wherein the pair of support legs are each pivotally mounted to a mounting bracket.

8. The bicycle trainer of claim 1, wherein the pair of support legs each include a flexible and adjustable leveling support pad.

9. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member, the first axle adapted to be connected to a pair of drop-outs from a bicycle with a rear wheel removed from the pair of drop-outs to operably connect the bicycle to the bicycle trainer;

a resistance unit drivingly coupled to the first axle; and a lockout mechanism that is selectively engageable to prevent movement between the glide base and the center structure.

10. The bicycle trainer of claim 1, wherein the resistance unit includes a flywheel.

11. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member; and a resistance unit drivingly coupled to the first axle, wherein the first curved track includes a pair of first curved track members on opposite sides of the glide base and the first guide roller includes a pair of first guide rollers on opposite sides of the glide base and each engaged with a respective one of the pair of first curved track members.

12. The bicycle trainer of claim 11, wherein the glide base includes a rear bracket that supports the first support guide roller and an elongated rail that supports the second support guide roller.

13. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member; and a resistance unit drivingly coupled to the first axle, wherein the first support guide roller includes a pair of first support guide rollers and the rear bracket is U-shaped with one of each of the pair of first support guide rollers being supported to a respective leg of the U-shaped rear bracket and the main frame member is pivotally coupled between the legs of the U-shaped rear bracket.

14. The bicycle trainer of claim 11, wherein the center structure includes an elongated leg and the pair of first curved track members are disposed on opposite sides of the elongated leg.

15. The bicycle trainer of claim 11, wherein the frame assembly is vertically adjustable.

16. The bicycle trainer of claim 11, wherein the frame assembly includes an adjustment bracket pivotally connected with the main frame member and adjustably connected to the glide base.

17. The bicycle trainer of claim 11, wherein the pair of support legs are each pivotally mounted to the mounting bracket.

18. The bicycle trainer of claim 11, wherein the pair of support legs each include a flexible and adjustable leveling support pad.

19. The bicycle trainer of claim 11, wherein the frame assembly includes a mounting bracket connected to the pair of support legs and the center structure.

20. A bicycle trainer comprising:

a frame assembly including a pair of support legs connected to a center structure, the center structure including a first curved track and a second curved track longitudinally spaced along the center structure from the first curved track, the frame assembly including a glide base having a first guide roller engaged with the first curved track and a second guide roller engaged with the second curved track, the frame assembly including a main frame member coupled to the glide base;

a first axle supported by the main frame member;

a resistance unit drivingly coupled to the first axle; and a lockout mechanism that is selectively engageable to prevent movement between the glide base and the center structure.

21. The bicycle trainer of claim 11, wherein the resistance unit includes a flywheel.

22. A bicycle trainer comprising:

a frame assembly including a pair of support legs connected to a center structure and a glide base slidable relative to the center structure the frame assembly including a main frame member coupled to the glide base;

an axle supported by the main frame member;

a resistance unit drivingly coupled to the axle; and a lockout mechanism that is selectively engageable to prevent slidable movement between the glide base and the center structure.

* * * * *